United States Patent [19]

Eguizabal

[11] 4,065,866

[45] Jan. 3, 1978

[54] MUZZLE LOADING FIREARM

[75] Inventor: Julian Eguizabal, Eibar, Spain

[73] Assignee: Pioneer Products, Inc., Old Saybrook, Conn.

[21] Appl. No.: 753,649

[22] Filed: Dec. 23, 1976

[51] Int. Cl.[2] ..... F41C 21/00

[52] U.S. Cl. ..... 42/51; 42/76 R

[58] Field of Search ..... 42/51, 83, 69 R, 76 R

[56] References Cited

U.S. PATENT DOCUMENTS

| | | | |
|---|---|---|---|
| 15,292 | 7/1856 | Halsey | 42/51 |
| 21,802 | 10/1858 | Schenkl | 42/51 |
| 28,677 | 6/1860 | Lord | 42/83 |
| 36,464 | 9/1862 | Hopkins | 42/51 |

FOREIGN PATENT DOCUMENTS

| | | | |
|---|---|---|---|
| 2,403 | 11/1871 | France | 42/51 |

*Primary Examiner*—Charles T. Jordan

[57] ABSTRACT

A muzzle loading firearm includes a barrel having a bore and a breech plug closing the breech end of the bore. An aperture in the barrel adjacent the breech end is adapted to mount a bolster which extends into the breech end of the bore. A flash transfer orifice communicates with a flash chamber in the bolster which in turn communicates with the breech end of the bore to permit firing of a powder charge contained therein. The firing chamber has an end wall located transversely opposite the aperture so that firing forces which would otherwise tend to bias the bolster outwardly of the aperture are resisted by firing forces acting on the end wall. Rearward biasing of the bolster against the breech plug by the firing forces is resisted by seating of the bolster within the aperture.

12 Claims, 5 Drawing Figures

MUZZLE LOADING FIREARM

BACKGROUND OF THE INVENTION

The present invention is concerned with muzzle loading firearms such as percussion cap or flintlock muzzle loading rifles and pistols. While such firearms are and have been for some time technologically obsolete, they are nonetheless still manufactured. Collectors and enthusiasts of such firearms, such as historical societies, collect, maintain, and fire such firearms.

Naturally, the basic construction of muzzle loading firearms has long been known. U.S. Pat. No. 15,292 shows a breech plug threadibly engaged in the barrel with a nipple having a tube communicating with the powder charge within the bore. A similar construction is shown in U.S. Pat. No. 36,464.

One problem with this classic construction is that firing of the powder charge to propel the projectile from the barrel generates firing forces which act against the bolster and bias it in a direction tending to displace the bolster out of the aperture in which it is threaded. The firing forces similarly act against the breech plug and bias it in a direction tending to displace the breech plug rearwardly out of the barrel. Only the threaded engagement of, respectively, the breech plug and bolster resist the displacement action on the firing forces. Proper functioning of the firearm and the safety of the person firing it are endangered as the threads engaging the breech plug and bolster wear and/or weaken with age and repeated firings.

It is accordingly an object of the present invention to provide a novel muzzle loading firearm which overcomes the foregoing problem.

It is another object of the present invention to provide a novel bolster design in which firing forces acting on the bolster are precluded from biasing the bolster outwardly of the aperture in which it is mounted on the barrel.

It is another object of the present invention to provide a novel bolster design in which said bolster is mounted in said barrel in a manner which shields the breech plug from firing forces tending to displace the breech plug rearwardly out of the barrel.

SUMMARY OF THE INVENTION

In accordance with the present invention there is provided in a muzzle loading firearm which is adapted to fire a powder charge the combination comprising a barrel having a breech end and a muzzle end and a bore extending longitudinally therethrough to define an annular barrel wall. The bore is closed at the breech end and the barrel wall has an aperture extending through it radially of the barrel and opening into the bore at the breech end. A bolster has a body portion and is mounted in the aperture with the body portion extending transversely into the bore interiorly of the closed breech end of the barrel. A flash chamber is formed in the body portion. The flash chamber is disposed within and opens into the bore and is adapted to receive a powder charge therein. The flash chamber is defined in part by an end wall of the body portion, which end wall is spaced from the aperture transversely of the bore so that the flash chamber is disposed in alignment with and between the aperture and the end wall. A flash transfer orifice is formed in the bolster which orifice communicates the flash chamber exteriorly of the barrel to provide a path for transmission of a flash from exteriorly of the barrel to the flash chamber.

Certain objects of the invention are attained when the bore is closed at its breech end by a breech plug, and when the body portion of the bolster engages the breech plug to retain the breech plug in place against biasing of the breech plug outwardly of the breech end of the barrel.

Certain objects of the invention are attained by providing in a muzzle loading firearm the combination comprising a barrel having a muzzle end and a breech end and a longitudinally extending bore formed therein to define an annular barrel wall. An aperture extends through the barrel wall radially of the barrel into the bore and a bolster is removably seated in the aperture and extends transversely across the bore. A flash chamber is formed within the bolster and is disposed within the bore. The flash chamber is adapted to receive therein a powder charge to be fired and is open on a side thereof facing the muzzle end of the barrel and is closed by an end wall on a side of the flash chamber which is transversely opposite and spaced from the aperture. As a result, firing forces generated by firing the powder charge and which would otherwise bias the bolster outwardly of the aperture are resisted by oppositely acting firing forces acting on the end wall.

Other objects of the invention are attained by threading the aperture and providing threads on the bolster adapted to threadibly engage the bolster in the aperture. The flash chamber advantageously comprises a blind passage within the body portion of the bolster, the end wall closing the bottom of the blind passage and an opening facing the muzzle end being formed in the body portion to communicate the blind passage with the barrel bore.

Figure 3:
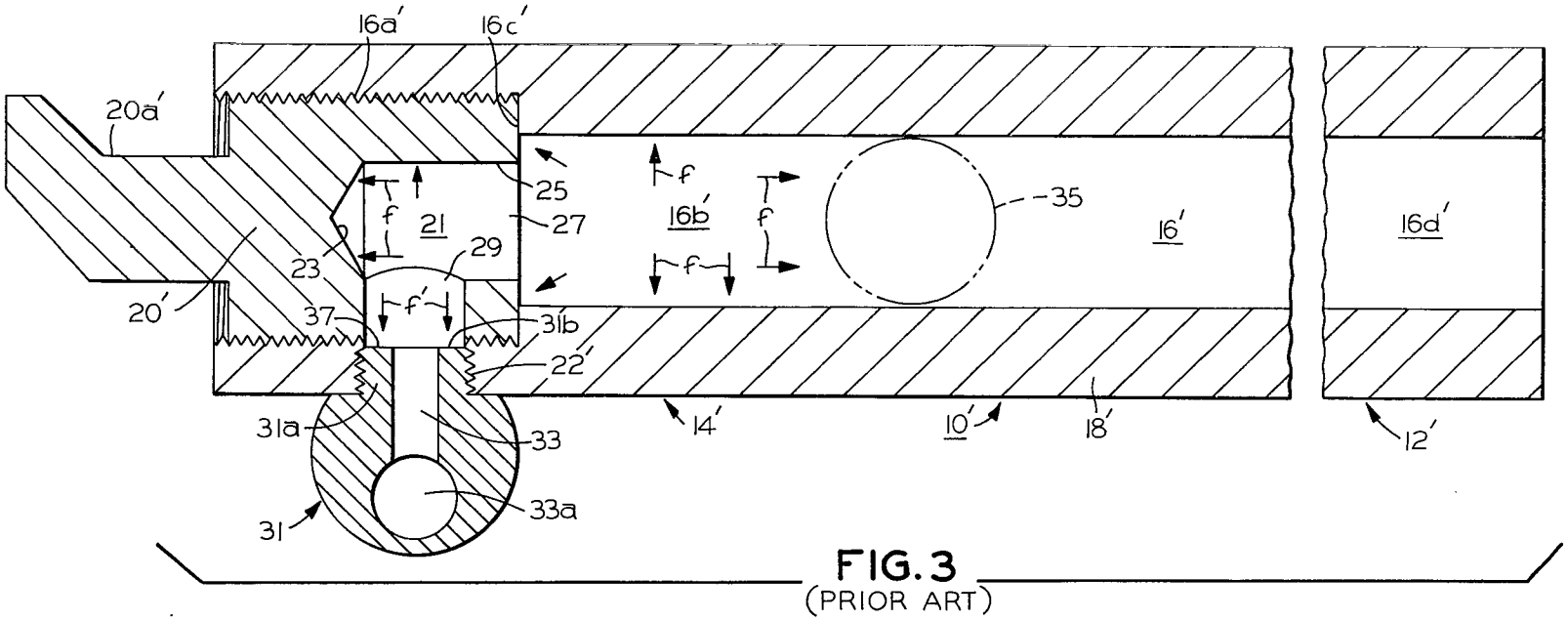
FIG. 3 (PRIOR ART)
FIG. 3 is a view corresponding to that of FIG. 2 but showing a prior art device.

Referring first to the prior device shown in FIG. 3, the barrel of a muzzle loading firearm is generally indicated at 10', the muzzle end thereof being generally indicated at 12' and the breech end thereof at 14'. A bore 16' extends longitudinally along the barrel to define an annular barrel wall 18'. The breech end 14' of barrel 10' is closed by a breech plug 20' which is threadibly engaged with an enlarged portion **16*a'* of bore 16'. Enlarged breech end 16*a'* of bore 16' is threaded along its length to threadibly engage with threads provided on the outer portion of breech plug 20'. Tang 20*a'* may be used to thread breech plug 20' in place. Proper positioning of breech plug 20' is insured by the stop provided by shoulder 16*c'* which seats breech plug 20' in proper position relative to aperture 22'. Breech plug 20' is of conventional construction, having the usual tang 20*a'* formed at the exterior end thereof and a cylindrical shaped flash chamber 21 formed therein at the opposite, interior end thereof. Flash chamber 21 has a conical shaped bottom 23 and is generally cylindrical in configuration having a cylindrical side wall 25 and an open end 27 which opens into bore 16' and faces towards muzzle end 12' of barrel 10'. Breech plug 20' has a radially extending side passage 29** formed therein.

An aperture 22' is formed in barrel wall 18' and extends therethrough radially with respect to barrel 10'. Walls of aperture 22' are threaded and a bolster 31 is adapted to be mounted therein. Bolster 31 has a flash transfer orifice 33 formed therein which communicates, via enlarged portion **33*a* of orifice 33, form exteriorly of barrel 10' to firing chamber 21, via side passage 29. Enlarged portion 33*a* of flash transfer orifice 33 extends through bolster 31 and is open to receive a firing cap (not shown) or other means to ignite the powder charge. Bolster 31 contains a necked-down portion 31*a* which is threaded to threadibly engage with the threads formed on the walls of aperture 22'. Bolster 31 has an inner end 31*b* which is exposed to firing chamber 21 via passage 29, and closes the latter except for the opening provided by flash transfer orifice 33**.

Firearms of the type shown are adapted to fire a projectile 35 (shown in dot dash outline) by firing a charge of powder (not shown) packed into firing chamber 21 and into that portion **16*b'* of bore 16' located between projectile 35 and firing chamber 21. The appellation "muzzle loading" is derived from the fact that such weapons are normally loaded by introducing the powder charge and projectile 35 from the muzzle end 12' of the barrel. With projectile 35 and the powder charge in place, a firing cap or the flash pan (not shown) of a flintlock type firearm is utilized in the known manner to generate a spark via flash transfer orifice 33*a*, 33, which spark ignites the powder charge contained in firing chamber 21 and bore portion 16*b'***. The explosive force of the fired powder charge is indicated by the arrows *f* representing the firing forces which act against the barrel wall 18', side wall 25 and bottom 23 of firing chamber 21, the reaction thereto forcing projectile 35 from barrel 10'. As noted, firing forces *f'* act against the inner end 37 of bolster 31 and bias the latter outwardly out of aperture 22'. Only the engagement of the threads of the necked-down portion **31*a* of bolster 31 engaging with the threads of aperture 22' resist this outward biasing force. If the threads wear, or are weakened with age, the firearm is subject to the malfunction of the force of the powder explosion expelling bolster 31 outwardly of aperture 22'**, with risk of injury to the firer of the weapon. Similarly, firing forces as represented by the arrows *f* tend to bias breech plug 20' leftwardly (as viewed in FIG. 3) outwardly of the breech end 14' of barrel 10'. This outward biasing force acting on breech plug 20' is resisted only by the engagement of the threads on breech plug 20' with the threads on enlarged breech end **16*a'* of bore 16'. Explosive forcing of breech plug 20' out of barrel 10'** is also a danger, with prior art devices.

Figure 1:
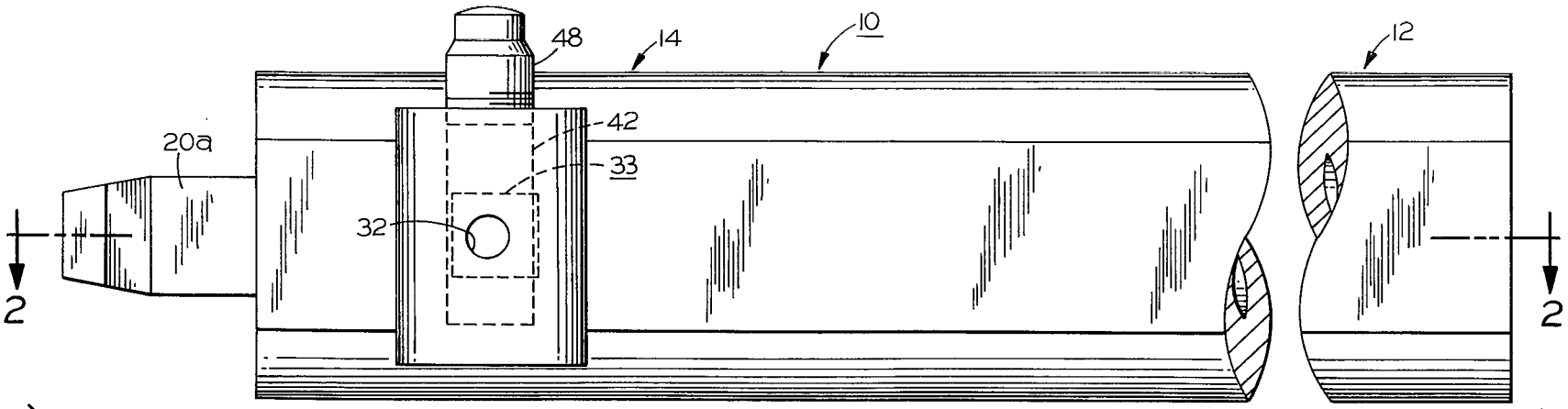
FIG. 1 is a somewhat schematic partial view in elevation of the barrel portion of a firearm including one embodiment of the present invention.
Figure 2:
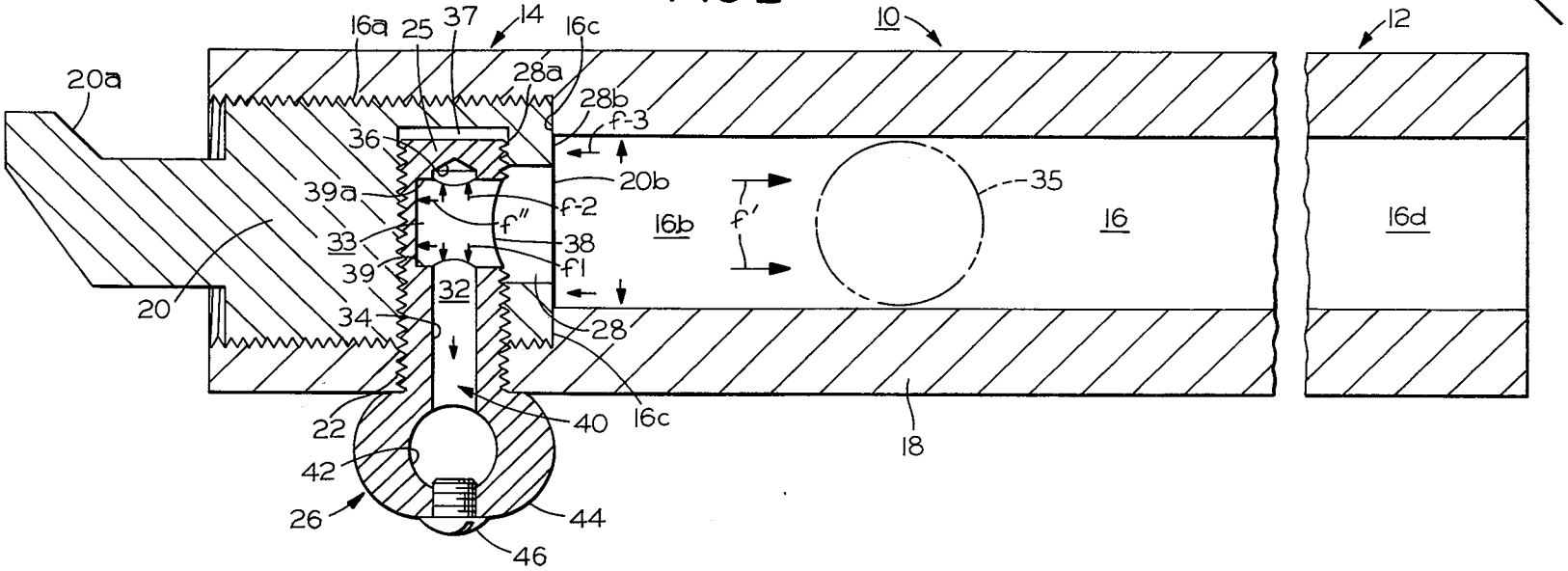
FIG. 2 is a plan section view taken along line 2—2 of FIG. 1.

Referring now to FIGS. 1 and 2, there is shown an embodiment of the present invention wherein certain parts corresponding to those of the prior art embodiment of FIG. 3 are similarly numbered, but without the prime designation. Thus, the firearm has a barrel 10 having a muzzle end 12 and a breech end 14, the bore 16 extending longitudinally of the barrel to define an annular barrel wall 18. Bore 16 has an enlarged portion **16*a* which is threaded to receive a breech plug 20, the outer surface of which is correspondingly threaded whereby tang 20*a* may be employed to thread breech plug 20 into place, shoulder 16*c*** serving as a stop.

Figure 2B:
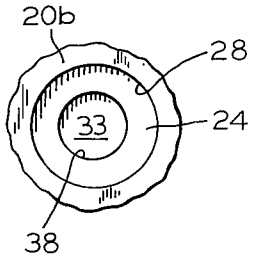
FIG. 2B is a partial view of the right hand (as viewed in FIG. 2) end of the breech plug shown in FIG. 2.
Figure 2A:
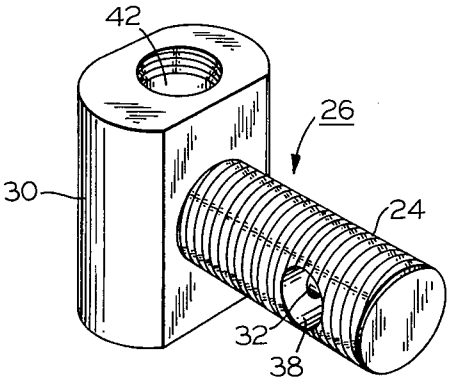
FIG. 2A is a perspective view of the bolster shown in FIG. 2.

As best seen in FIG. 2A, a bolster 26 has a body portion 24, and a stem portion 30. A flash chamber 33 is formed within body portion 24 by a blind passage 32, which may be cylindrical in shape and have a cylindrical side wall 34 and a conical-shaped bottom 36. An opening 38 is formed in body portion 24 and intersects with passage 32 to open the latter exteriorly of body portion 24 to bore 16 in a direction facing muzzle end 12 of barrel 10. Flash chamber 33 is comprised generally of opening 38 and that portion of passage 32 adjacent opening 38. Opening 38 has a side wall 39. The portion **39*a* of side wall 39 which is located on the side of opening 38 opposite aperture 22, and bottom 36 of passage 32 cooperate to define an end wall 25 in body portion 24. End wall 25 defines in part flash chamber 33 and is opposite aperture 22 and spaced therefrom transversely of bore 16. Flash chamber 33 is thereby seen to be disposed in alignment with and between aperture 22 and end wall 25. A flash transfer orifice 40 is provided by an enlarged opening 42, which passes through stem portion 30 of bolster 26, and the balance of blind passage 32. Blind passage 32 extends to and through outer end 44 of bolster 26 as a manufacturing convenience to permit boring of passage 32. A small threaded bolt 46 closes passage 32 at outer end 44**.

An aperture 22 extends through barrel wall 18 radially of barrel 10 and opens into bore 16. Aperture 22 is located at the breech end of barrel 10. Aperture 22 may be threaded to engage a threaded portion of bolster 26, as described hereinbelow.

Breech plug 20 has a cylindrical shaped passage 37 formed therein which is adapted to receive body portion 24 of bolster 26. An opening 28 formed in breech plug 20 leads to cylindrical passage 37 and opens to the breech end **16*b* of bore 16 when bolster 26 is assembled in barrel 10 as more fully described below. After breech plug 20 has been affixed to barrel 10 by being threaded into breech end 14 thereof, bolster 26 is inserted through aperture 22 and secured therein by engagement of threads provided on the exterior of body portion 24 of bolster 26 along that portion thereof adjacent stem portion 30. The major portion of body portion 24 is thus received within passage 37 of breech plug 20. Opening 38 in body portion 24 of bolster 26 is aligned with opening 28 at the end of breech plug 20, as best seen in FIGS. 2 and 2*B*. Opening 28 in breech plug 20 is seen to be sized so that body portion 24 extends across and beyond opening 28 with body portion 24 engaging shoulders 28*a* formed about the interior of opening 28. In this manner, body portion 24 engages breech plug 20 to retain breech plug 20 in place against biasing of breech plug 20 outwardly of breech end 14 of barrel 10. Passage 37 may be threaded and corresponding exterior portions of body portion 24 threaded to threadibly engage body portion 24, or a portion thereof, within passage 37**.

In use, a powder charge (not shown) and projectile 35 (shown in dot dash outline) are loaded from muzzle end 12 of barrel 10 with the powder charge filling the firing chamber 33, flash transfer orifice 40 and a portion **16*b* of the breech end of bore 16. A flash is generated in flash transfer orifice 40 in the known manner as by firing of a percussion cap 48 mounted in enlarged portion 42 of orifice 40 as schematically shown in FIG. 1. The flash generated travels through flash transfer orifice 40 to ignite the powder charge in flash chamber 33 and portion 16*b* of bore 16. The resultant firing forces are indicated by the arrows in FIG. 2**, the forces indicated by the arrows *f'* serving to propel projectile 35 from the barrel. Firing forces indicated by the arrows *f''* act against the left-hand portion (as viewed in FIG. 2) of cylindrical side wall 34. Firing forces indicated by arrows *f*-1 which would otherwise tend to bias bolster 26 outwardly of aperture 22 are balanced by firing forces indicated by the arrow *f*-2 acting against end wall 25 of flash chamber 33. It is seen that firing forces tending to expel bolster 26 outwardly of bore 16 through aperture 22 are balanced by oppositely acting firing forces acting against end wall 25. Similarly, the seating of bolster 26 within aperture 22 resists firing forces acting to expel breech plug 20 outwardly of breech end 14 of bore 16. Bolster 26, ie, main body portion 24 thereof, at least partially shields breech plug 20 from the firing forces. The engagement of bolster 26 with breech plug 20 requires that the firing forces must be such as to rupture 26 (and/or barrel 10) before breech plug 20 or bolster 26 can be expelled outwardly of bore 16.

In the embodiment shown, a shoulder portion 28*b* adjacent the exterior of opening 28 in inner end 20*b* of breech plug 20 projects radially inwardly of bore 16 and is therefore subject to firing forces (indicated by arrows *f*-3) which tend to bias breech plug 20 leftwardly (as viewed in FIG. 2) out of breech end 14 of barrel 10. Enlargement of opening 28 so that its diameter is at least as large as that of bore 16 would prevent this biasing force action. But this is not necessary since bolster 26 secures breech plug 20 against all the firing forces acting on it.

It will be appreciated that the novel design of the bolster and breech plug engages the breech plug with the bolster and seats the latter in the radial aperture provided in the barrel wall. This permits the bolster to hold the breech plug against expulsion of the latter from the barrel without relying solely on the threaded or other engagement of the breech plug with the barrel. The novel design of the invention also provides the firing chamber within the bolster, the firing chamber being defined in part by an end wall which is disposed transversely, with respect to the barrel, opposite the radial aperture through which the bolster is inserted into the barrel. This balances firing forces which would otherwise tend to bias the bolster outwardly of the radial aperture.

While the invention has been described with respect to one embodiment in which a stem portion is provided on the bolster to receive a percussion cap, it will be apparent to those skilled in the art that the stem and percussion cap may be omitted and the flash pan of a flintlock type rifle affixed to the barrel in lieu of the stem. In such case, the spark generated in the flash pan ignites the powder, the flash transfer orifice in the main body portion of the bolster opening to the flash pan to receive the spark generated therein. In either case, the powder charge fills the firing chamber and flash transfer orifice to insure that the flash travels through the latter into the flash chamber to ignite the charge.

It will be apparent that upon a reading and understanding of the foregoing, numerous alterations and modifications of the described specific embodiment will occur to those skilled in the art, and it is intended to include all such modifications and alterations within the scope of the appended claims.

I claim:

1. In a muzzle loading firearm adapted to fire a powder charge contained therein, the combination comprising:

a. a barrel having a breech end and a muzzle end and a bore extending longitudinally therethrough to define therein an annular barrel wall, said bore being closed at said breech end, said barrel wall having an aperture extending therethrough radially of said barrel and opening into said bore at said breech end;

b. a bolster having a body portion and being mounted in said aperture with said body portion extending transversely into said bore interiorly of the closed breech end of said barrel;

c. a flash chamber formed in said body portion, said flash chamber being disposed within and opening into said bore and being adapted to receive a powder charge therein, said flash chamber being defined in part by an end wall of said body portion, which end wall is spaced from said aperture transversely of said bore whereby said flash chamber is disposed in alignment with and between said aperture and said end wall; and d. a flash transfer orifice in said bolster which orifice communicates said flash chamber exteriorly of said barrel to provide a path for transmission of a flash from exteriorly of said barrel to said flash chamber.

2. The combination of claim 1 wherein said bore is closed at its breech end by a breech plug.

3. The combination of claim 2 wherein said body portion of said bolster engages said breech plug to retain said breech plug in place against biasing of said breech plug outwardly of said breech end of said barrel.

4. The combination of claim 3 wherein said breech plug is threadibly engaged in said bore at said breech end of said barrel and said bolster is threadibly engaged in said aperture.

5. The combination of claim 2 wherein said bolster further includes a stem portion which is disposed exteriorly of said barrel, and said flash transfer orifice passes through said stem portion.

6. The combination of claim 2 further including means to fire a powder charge contained within said flash chamber by generating a flash in said flash transfer orifice.

7. The combination of claim 6 wherein said bolster includes a stem portion which is disposed exteriorly of said barrel and said flash transfer orifice passes through said stem portion, and wherein said means to fire said powder charge comprises a firing cap adapted to be received on said stem portion in communication with said flash transfer orifice.

8. The combinationn of claim 2 wherein said flash chamber is formed at least in part by a blind passage formed within said body portion of said bolster, said end wall closing the bottom of said blind passage, an opening is formed in said body portion, said opening serving to open said blind passage to said bore in a direction facing said muzzle end of said barrel.

9. The firearm of claim 2 wherein said breech plug has an opening therein which extends transversely of said bore and said body portion of said bolster is received within said opening in said breech plug to retain said breech plug in place against biasing of said breech plug outwardly of said breech end of said barrel.

10. In a muzzle loading firearm, the combination comprising:

a barrel having a muzzle end and a breech end and a longitudinally extending bore formed therein to define an annular barrel wall;

an aperture extending through said barrel wall radially of said barrel into said bore;

a bolster seated in said aperture and extending transversely across said bore; and a flash chamber formed within said bolster and disposed within said bore, said flash chamber being adapted to receive therein a powder charge to be fired, said flash chamber being open on a side thereof facing said muzzle end of said barrel and being closed by an end wall on a side of said flash chamber transversely opposite and spaced from said aperture, whereby firing forces generated by firing said powder charge and which would otherwise bias said bolster outwardly of said aperture are resisted by oppositely acting firing forces acting on said end wall.

11. The combination of claim 10 wherein said breech end of said barrel is closed by a breech plug and said bolster extends across said bore interiorly of said breech plug to at least partially shield said breech plug from said firing forces.

12. The combination of claim 11 wherein said bolster engages said breech plug to retain said breech plug in place against biasing of said breech plug outwardly of said breech end of said barrel.

* * * * *